United States Patent [19]

Gorski et al.

[11] Patent Number: 5,028,170

[45] Date of Patent: Jul. 2, 1991

[54] APPARATUS AND METHOD FOR CONTINUAL REMOVAL OF REINFORCED PAVEMENT WITH SIMULTANEOUS SEPARATION AND RENDERING OF A BULK COMPONENT FROM A REINFORCEMENT COMPONENT THEREOF

[76] Inventors: George Gorski; Donald D. Zamzow, both of P.O. Box 358, Wausau, Wis. 54402-0358

[21] Appl. No.: 292,053

[22] Filed: Dec. 30, 1988

[51] Int. Cl.[5] ..... E01C 23/12

[52] U.S. Cl. ..... 404/72; 241/101.7; 299/37; 299/69; 404/90

[58] Field of Search ..... 299/14, 36, 37, 69; 404/72, 90, 91, 133; 241/101.7

[56] References Cited

U.S. PATENT DOCUMENTS

| | | | |
|---|---|---|---|
| 2,768,794 | 10/1956 | Putnam | 404/90 X |
| 4,309,126 | 1/1982 | Pfaff | 299/37 X |
| 4,560,207 | 12/1985 | Eftefield et al. | 299/10 |
| 4,692,058 | 9/1987 | Mengel | 404/90 X |

*Primary Examiner*—Ramon S. Britts

*Assistant Examiner*—David J. Bagnell

*Attorney, Agent, or Firm*—Lowe, Price, LeBlanc, Becker & Shur

[57] ABSTRACT

A system is provided for forcibly drawing a flexibly-supported, acute angled, wedge under an existing stretch of a predetermined width of reinforced pavement to initiate removal thereof from the ground below. Gravity-assisted impact hammers apply downward blows of a controlled magnitude and at a predetermined rate onto an upper surface of the reinforced pavement, to crack the same across the entire width thereof over the wedge being driven therebelow. The wedge is flexibly supported, with a predetermined amount of elasticity in the up-and-down direction, so that it essentially "floats" and facilitates absorption of the impact forces by the reinforced pavement to be cracked thereby. Cracked reinforced pavement is subjected to further blows by a hammer coacting with a set of bars transverse thereto, to forcibly render a bulk component of the reinforced pavement into small pieces separated from reinforcement material contained therein. The reinforcement material, is now separated from the bulk component, chopped up and delivered in a flow separate from that of the rendered bulk component.

8 Claims, 6 Drawing Sheets

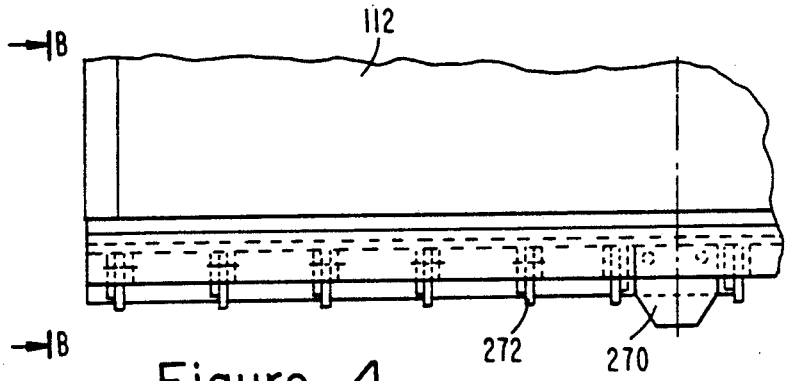
Figure 4
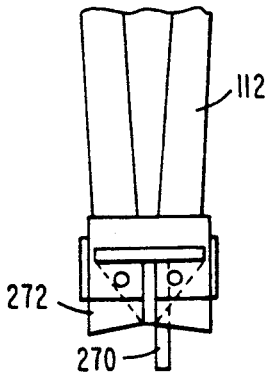
Figure 5
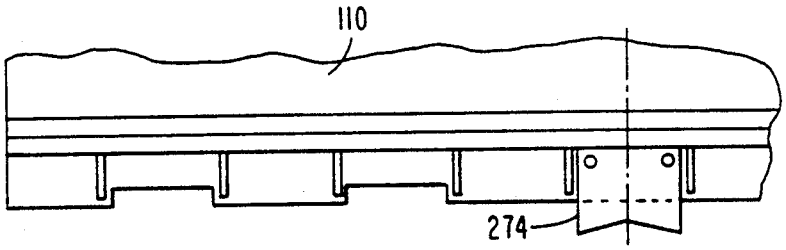
Figure 6
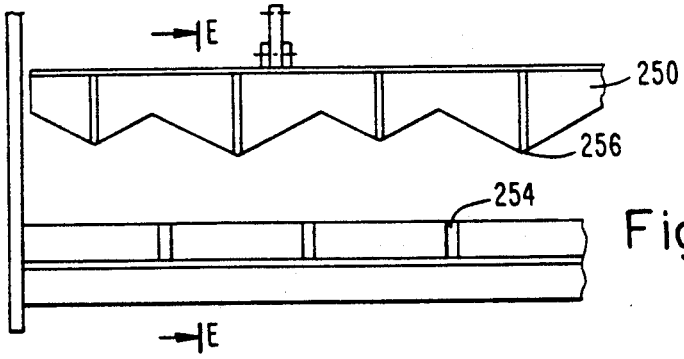
Figure 7
Figure 8
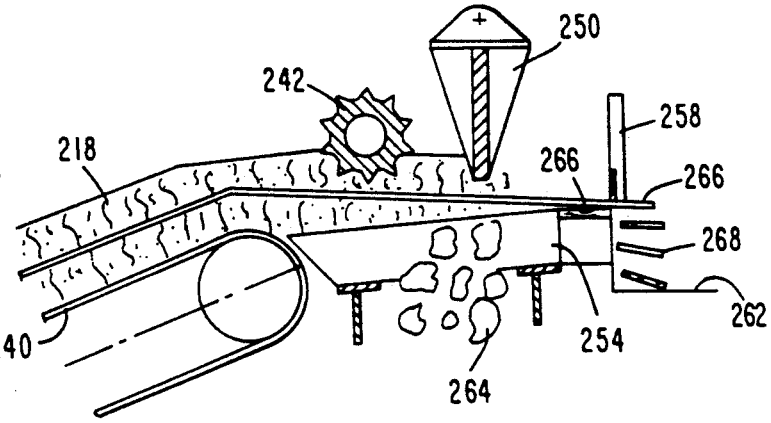

APPARATUS AND METHOD FOR CONTINUAL REMOVAL OF REINFORCED PAVEMENT WITH SIMULTANEOUS SEPARATION AND RENDERING OF A BULK COMPONENT FROM A REINFORCEMENT COMPONENT THEREOF

FIELD OF THE INVENTION

This invention relates to apparatus and a method for continually breaking up and removing reinforced road pavement and, more particularly to an apparatus and a method for simultaneously separating a bulk component from a reinforcement component of the reinforced pavement and rendering both components for delivery thereof into separate flows.

BACKGROUND OF THE INVENTION

Many existing highway systems as well as substantial portions of the landing zones of air fields for receiving large and heavy aircraft are formed of reinforced concrete pavement. Inevitably, with the passage of time and upon subjection to various forces during use, even such reinforced pavement suffers deterioration and must eventually be replaced. Even otherwise, as when an existing highway must be replaced by a wider or sturdier highway to accommodate changing needs, existing reinforced pavement often needs to be removed and/or replaced.

Although numerous forms of pavement breaking apparatus and methods are in use today, they tend to be relatively inefficient and slow, at times labor intensive, and highly disruptive of existing traffic patterns. Known apparatus of this type ranges from the simple pick and shovel known since biblical times, through pneumatic or hydraulic jackhammers and front end loaders that require skilled personnel to operate safely, to assorted power-driven multi-bladed devices that more or less chop up existing pavement in place to serve as a base for an additional layer of fresh pavement thereon. Such apparatus and methods for using the same leave much to be desired.

U.S. Pat. No. 4,692,058 to Mengel, issued on Sept. 8, 1987, discloses apparatus and a method for removing pavement wherein an acute angled wedge, wider than pavement that is to be broken up and removed, is forced under the pavement to exert a force to lift it off the underlying ground. A heavy, pivoted, and preferably hydraulically driven hammer hits the pavement above the front edge of the wedge and cracks the pavement at every few inches of its length by generating tensile forces in the lower portions of the lifted pavement under the applied impact force. A second hammer having a saw tooth impact surface profile thereafter renders the cracked pavement and any tensile reinforcement material included therein into smaller pieces but does so without separating the bulk component of the reinforced pavement, e.g., concrete material, from the tensile reinforcement material, typically steel bars or netting. In this apparatus, the acute angle wedge rests on the underlying ground from which packed pavement has been lifted by the wedge. The heavy hydraulically driven hammer is pivotably supported on a ramp drawn directly behind the wedge to force the wedge under the approaching pavement.

A need exists for apparatus and a method that can in a single pass rapidly and economically break up a substantial width of existing pavement to totally remove the same from the underlying ground while simultaneously separating the bulk component of the pavement from relatively valuable reinforcement material and for rendering both components into small pieces that are more easily handled and, therefore, more useful forms thereof.

DISCLOSURE OF THE INVENTION

Accordingly, it is an object of this invention to provide apparatus for continually, rapidly, and economically breaking up and removing a substantial width of an existing reinforced pavement.

It is another object of this invention to provide apparatus and a method for continually, rapidly, and economically breaking up and removing a substantial width of an existing reinforced pavement and for rendering the same into small pieces of predetermined size for easy removal thereof.

It is yet another object of this invention to provide apparatus for continually, rapidly, and economically breaking up a substantial width of an existing reinforced pavement, including any reinforcement material therein, and for separating a bulk component of the pavement from the reinforcement material for subsequent separate reuse thereof.

It is yet another object of this invention to provide apparatus and a method for continually, rapidly, and economically breaking up a predetermined portion of an expanse of existing reinforced pavement and to leave the ground underneath substantially ready to receive new pavement immediately thereafter.

It is a further object of this invention to provide apparatus and a method for continually, rapidly, and economically breaking up a predetermined width of existing reinforced pavement, separating a bulk component thereof from any reinforcement therein, for rendering both the bulk component and the reinforcement for delivery as separate flows, and for distributing the bulk component in its rendered form onto ground from which reinforcement pavement was removed for the formation of replacement reinforced pavement immediately thereafter.

These and other objects of this invention are realized in a preferred embodiment of the apparatus by providing a mobile system that advances to remove an existing layer of reinforced pavement, the system including a driving means for providing a forward drive to the system, movable lifting means driven forwardly by the drive means for thereby lifting a predetermined width of approaching reinforced pavement, impact means for applying gravity assisted controlled impact forces to the lifted reinforcement pavement to generate successive cracks therein substantially across the width thereof, means for rendering into pieces a bulk component of the cracked reinforced pavement for separating the pieces thereof from the reinforcement component and for delivering the rendered bulk component pieces in a first flow, and means for rendering the separated reinforcement component into pieces and delivering the same in a second, wherein both the bulk component rendering means and the reinforcement component rendering means are adapted to be moved in concert with the lifting means and the impact means by the driving means.

BRIEF DESCRIPTION OF THE DRAWINGS

FIG. 4 is a partial elevation view of one of two gravity assisted impact hammers according to a preferred embodiment of this invention (view A—A per FIG. 2B).

FIG. 5 is a partial and elevation view of the impact hammer of FIG. 4 (view B—B per FIG. 4).

FIG. 6 is a partial elevation view of a second hydraulic impact hammer according to a preferred embodiment of this invention, illustrating in particular a removable lane separator element attachable thereto (view C—C per FIG. 2B).

FIG. 7 is a partial elevation view of a bulk component rendering hammer according to a preferred embodiment of this invention (view D—D per FIG. 2B).

FIG. 8 is a partial side elevation view of means for rendering and separating a bulk component of removed reinforcement pavement according to a preferred embodiment of this invention (view E—E per FIG. 7).

Like elements and parts of elements are identified by the same numbers in all the figures and throughout the specification.

DESCRIPTION OF THE PREFERRED EMBODIMENT

A significant feature of this invention is the provision of a number of mobile units, the operational coaction of which is readily controlled by a single operator. The operator is most conveniently positioned in the forwardmost unit to view not only oncoming reinforcement pavement that is to be removed but also the other operating system units as well as any coworkers engaged nearby in the operation.

Figure 1A:
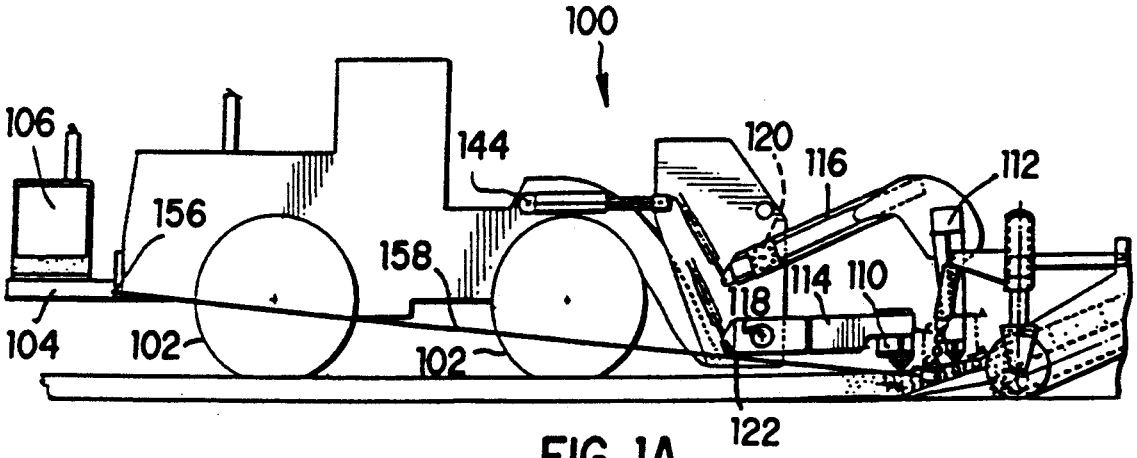
FIGS. 1A, 1B and 1C are side elevation views of successive portions of the mobile system according to a preferred embodiment of this invention.
Figure 1B:
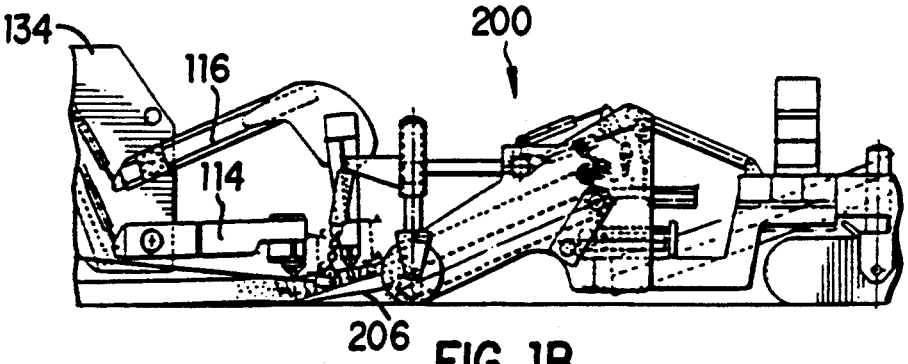
Figure 1C:
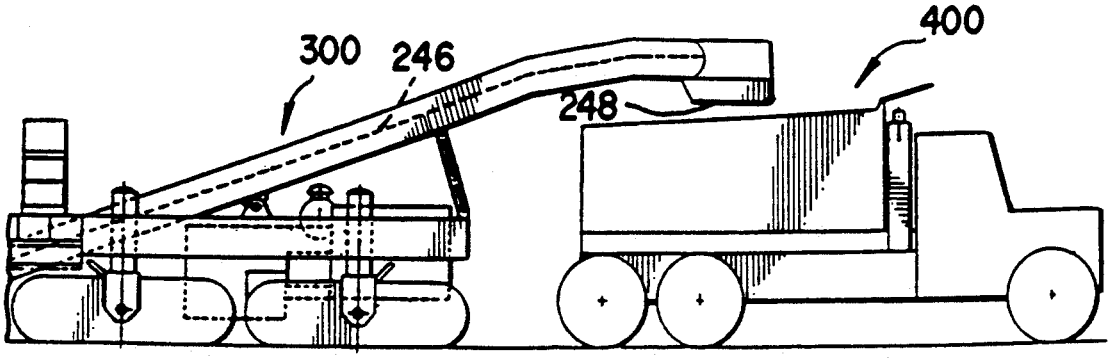

To gain an overview of the principal components of the system according to a preferred embodiment of this invention, reference should be had to FIGS. 1A, 1B and 1C as viewed from left to right in succession. Thus, per FIG. 1A, the entire system consists of a chain of connected and/or coacting elements advancing in the forward direction as indicated by the bold arrow above the left-hand side of FIG. 1A.

The forwardmost principal mobile unit of the advancing system in the preferred embodiment of the apparatus, as best seen in FIG. 1A, is a large, powerful, heavy-duty tractor unit 100 that rides on a portion of the reinforced pavement that has not yet been lifted from the underlying ground by the advancing system. As a practical matter, the operator of the system may most comfortably be situated in a cab of tractor unit 100 where he or she would have a clear view in the direction of advancement of the system as well as the components that follow tractor unit 100. A control system of known type (not illustrated or discussed in detail for conciseness and simplicity) is provided for use by the operator to control various operational parameters as discussed more fully hereinbelow.

Figure 2A:
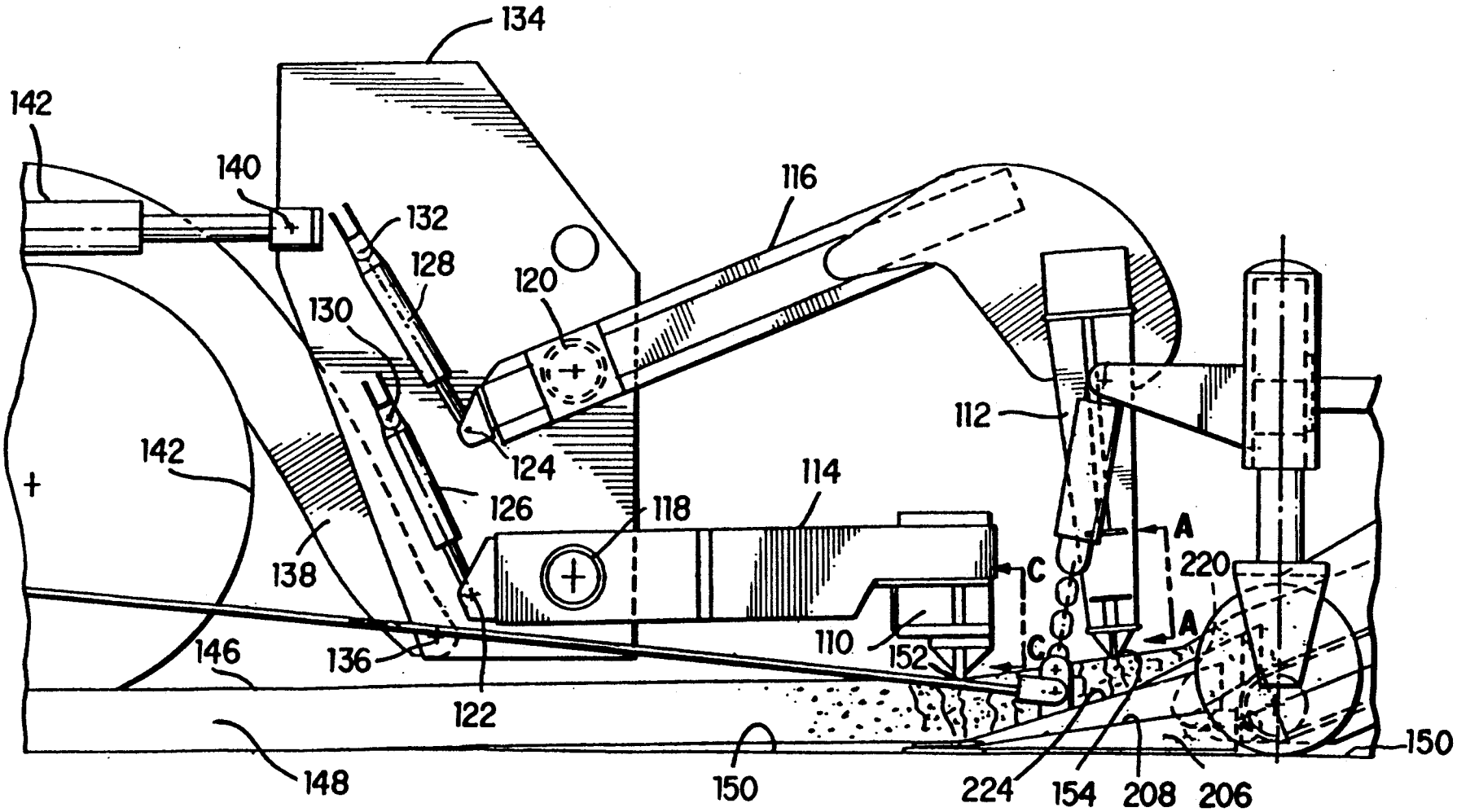
FIGS. 2A and 2B are enlarged elevation views of important coacting elements as illustrated to a smaller scale in FIG. 1B.
Figure 2B:
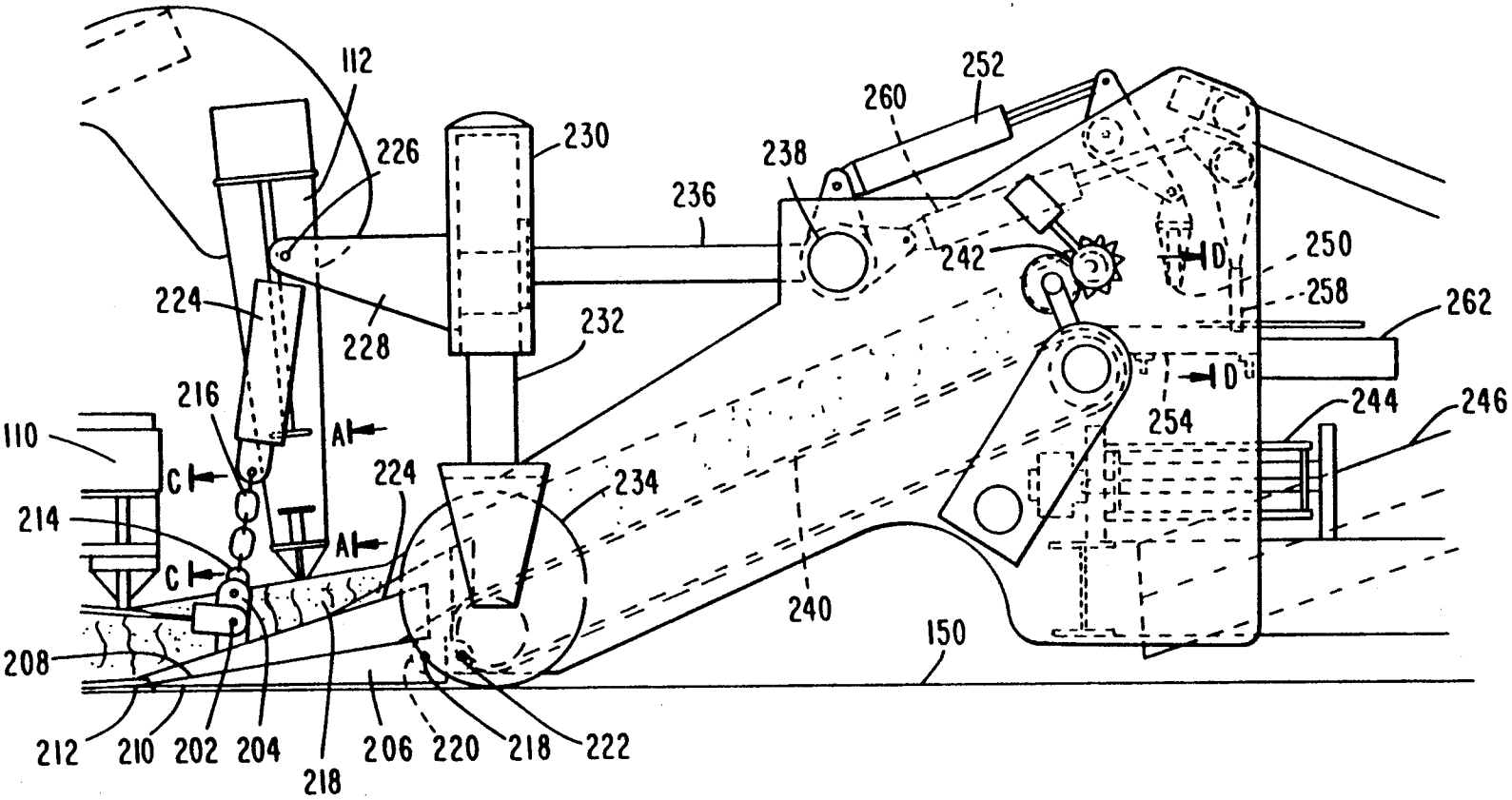

Tractor unit 100 tows immediately behind it a towed mobile unit 200, best seen in FIGS. 1B and 2B, that is preferably supported at its forward end by pneumatic tired wheels supported by the earth's surface newly exposed by removal of reinforcement pavement therefrom and, at a rear end, preferably by a tracked support unit 300 that may be provided with its own motive power and which is capable of bearing the substantial load of a significant length of removed reinforcement pavement and assorted rendering elements as also more fully discussed hereinbelow.

The tracked support unit 300, as best seen in FIG. 1C, supports an inclined conveyor belt for conveying rendered pieces of a bulk component, e.g., broken concrete, from the removed reinforced pavement for delivery to, for example, a heavy duty truck 400. In the alternative, the rendered pieces of removed bulk component from the removed reinforced pavement may be distributed evenly behind the moving system to provide a partial bed for the laying thereon of new reinforced pavement.

Figure 3A:
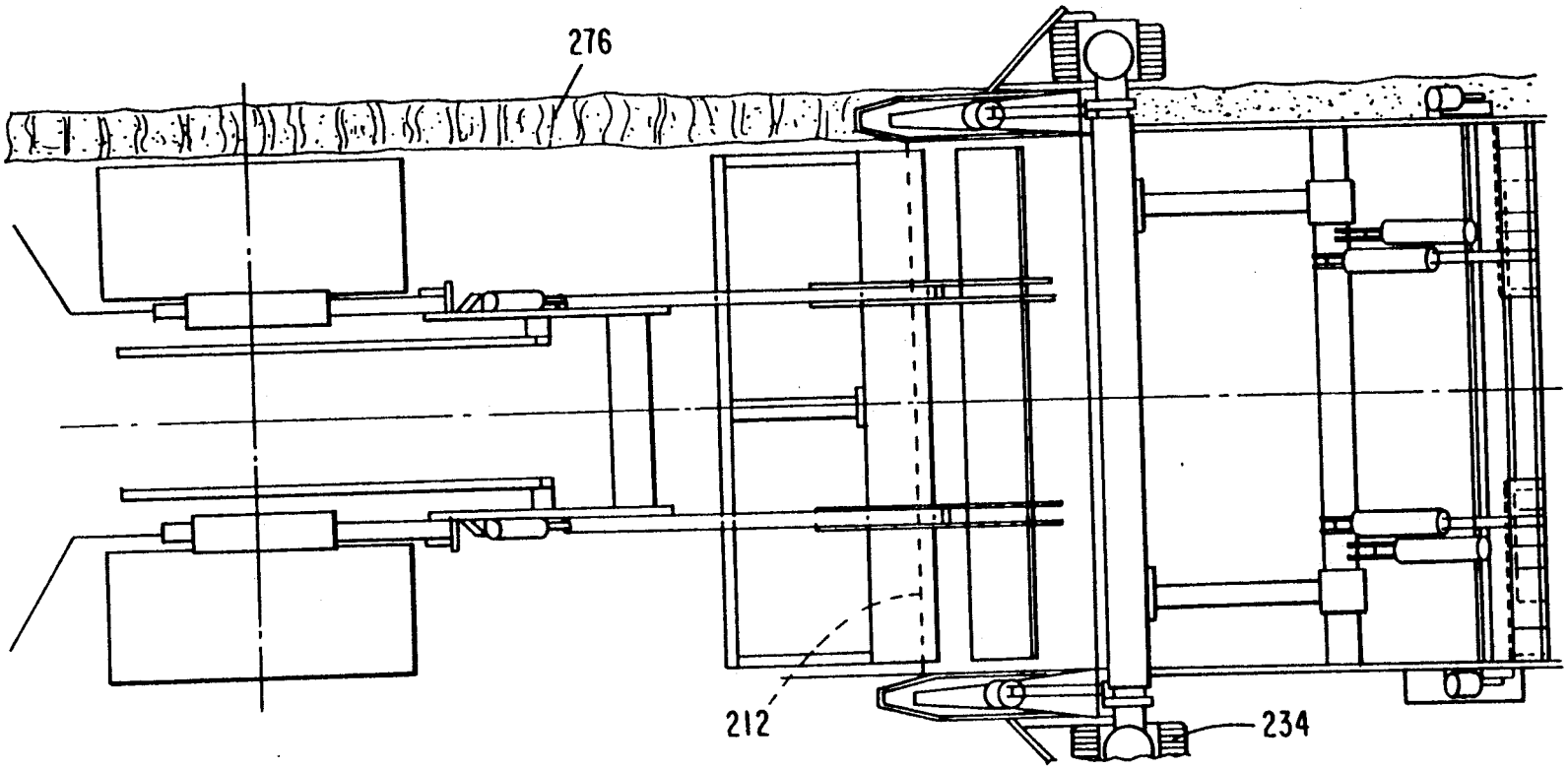
FIGS. 3A and 3B are partial plan views of the apparatus according to a preferred embodiment of this invention, particularly those portions that are illustrated in elevation view in FIG. 1B, 2A and 2B.
Figure 3B:
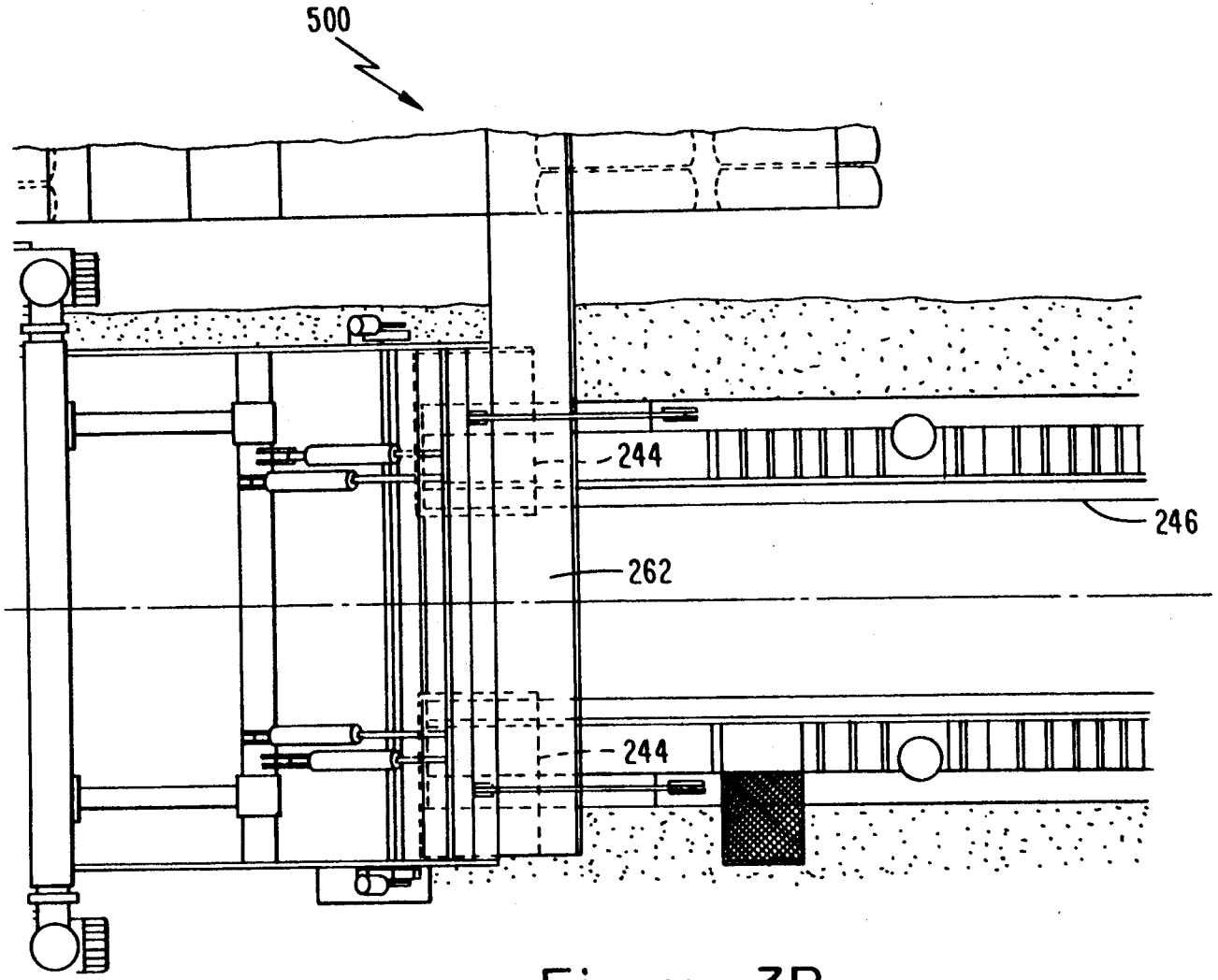

As is best seen in FIGS. 3B, pieces of the rendered reinforcement component are conveniently delivered to one side of the moving system, e.g., in the direction of arrow BC, preferably to be collected in a heavy-duty truck 500 moving alongside the system to receive and periodically take away the pieces of reinforcement material.

Tractor vehicle 100, preferably provided with pneumatic tires 102 to enable it to cope with the repeated shock loads encountered during use, is conveniently provided with a forwardly extending platform 104 to support a hydraulic pressurization unit 106 with its own independent drive engine. Unit 106 provides a supply of hydraulic fluid at a selected high pressure to enable controlled operation of, preferably, two gravity-assisted pivotally supported impact hammers, forward hammer 110 and rear hammer 112. These pavement-cracking hammers are supported at the ends of pivotable arms 114 and 116 that pivot, about strong, suitably sized, pivots 118 and 120, respectively as best seen in FIG. 2A. Also best seen in FIG. 2A, hammer arms 114 and 116 each extend to the other side of their respective pivots 118 and 120 and are there respectively connected at pivots 122 and 124 to hydraulically driven pistons contained in hydraulic cylinders 126 and 128, respectively. Hydraulic cylinders 126 and 128 are pivotally mounted at their respective closed ends at pivots 130 and 132, respectively, to a pivotally supported hammer-mounting element 134 which is itself pivotable about a pivot 136 at the distal end of an extension 138 mounted to tractor vehicle 100. Hammer-mounting element 134 is also connected to a hydraulic cylinder 142 at a distal end 140 of a piston thereof, with hydraulic cylinder 142 having a closed end pivotally mounted at pivot 144 to tractor vehicle 100.

Strong hydraulic lines, of known type and suitable rating, connect hydraulic pressurizing unit 106 to hydraulic cylinders 126, 128 and 142 to generate pivoting of hammer arms 114 and 116 and of hammer-mounting element 134 about their respective pivots 118, 120 and 136.

As persons skilled in the mechanical arts will appreciate, the provision of a high pressure fluid to cylinder 126 in a controllable manner can be used to pivot hammer arm 114 so as to raise forward hammer 110 to a suitable height above the level of the uppermost surface 146 of a reinforced pavement layer 148 resting on underlying ground 150. Upon release of pressure from hydraulic cylinder 126, the weight of hammer arm 114 and forward hammer 110 will immediately subject both to the action of the earth's gravitational field and cause them to drop so that a carefully shaped impact end of hammer 110 makes a forcible impact on the upper surface 146 of reinforcement pavement 148 at a first impact location 152. In actuality, depending upon the specific geometry provided to the impacting portion of forward hammer 110, this contact portion 152 may be an aggregation of contact points stretching transversely across a selected width of the reinforced pavement in a direction normal to the direction of motion of tractor vehicle 100.

In a very similar manner, rear hammer 112 can be raised and dropped by suitable control of the hydraulic pressure provided to hydraulic cylinder 128 to thereby generate gravity assisted impacts downwardly onto reinforcement pavement layer portion 154 that has already been subjected to one or more blows by first hammer 110. Rear hammer 112, again depending upon the specific geometry of its impact points, makes contact with the reinforced pavement at a location 154 which may itself be an aggregation of impact points stretching transversely across the reinforced pavement.

By suitable selection of the masses of hammer arms 114 and 116 as well as hammers 110 and 112, the respective heights to which hammers 110 and 112 are raised, the number of times they are caused to drop in a given unit of time, and the rate at which tractor vehicle 110 drives the system, the operator can control not only the magnitude of the impact forces provided by hammers 110 and 112 but, also, the number of such impacts by each per unit length of reinforced pavement passing thereunder to be cracked by such impact blows.

Persons skilled in the mechanical arts will also appreciate that by suitable control of hydraulic cylinder 142, hammer supporting element 134 may be pivoted about its lower pivot 136. This enable the operator to alter the location of pivots 118 and 120 with respect to both the tractor vehicle 100 and the underlying reinforced pavement that is to be cracked and removed. Readjustment of the position of hammer supporting element 134 thus provides an additional variable to the operator and he can adjust it to control in a very precise manner the angle at which the impacting portions of first and second hammers 110 and 112 each make contact with the underlying reinforced pavement 148 being cracked thereby.

It is an important and significant feature of this invention that the operator is thus afforded precise and individual control over the magnitude of the impact blows provided by first and second hammers 110 and 112, the angles at which both of these hammers apply their respective impact forces to the underlying reinforced pavement, the frequency with which blows struck by hammers 110 and 112 are applied, and the rate at which the entire system advances onto the selected portion of reinforced pavement that is to be removed.

With the sophisticated computer-assisted controls now available to operate industrial equipment, any of a large number of known and commercially available computer-assisted controls may be employed to program such operational parameters. Such an operational program can be based on past experience with particular types of reinforced pavement, the detected condition of the reinforced pavement being removed, local exigencies, the condition of the underlying ground, and other parameters material to the operation.

Tractor vehicle 100 has a convenient towing force application point 156, preferably adjacent a front bumper thereof, at which may be attached one or more suitably rated towing members 158 for providing a forwardly directed towing force to element 200 working in concert with hammers 110 and 112.

Towable element 200, best seen in FIGS. 1B and 2B in side elevation views, receives the towing force applied by a towing member 158 at a pivot point 202 provided on an extension 204 connected to a wedge 206 that has an upper surface 208 and a lower surface 210 meeting at a leading edge portion 212. In practice, there will preferably be two extensions 204, one at each side of wedge 206. Each extension 204 is also provided with a pivot point 214 at which an upward force is flexibly applied, preferably by a strong link chain 216, to support a portion of the load represented by the weight of wedge 206, the weight of "cracked" reinforced pavement identified as 218 for convenience of reference, and a downward component of the reaction force exerted by the weight and stiffness of hitherto unbroken reinforced pavement 148. Also, and very important in the present context, the support element 216, whether it is a link chain, a steel cable or the like, must also be flexible and strong enough to cope with the stresses imposed by repeated impacts by both first and second hammers 110 and 112 during use.

A rear portion of wedge 206 is pivotally supported at each side at a pivot 218 that is itself supported at a distal end of a swingable link 220 pivotally supported at another end at a pivot 222. For proper balance during operation, there should be at least one link 220 on each side of wedge 206. Note that end plates 224 may also be provided on each side of wedge 206 to guide cracked pavement upward along the upper surface 208 of wedge 206.

An upper end of suspension element 216 may be adjusted in height for operation of a suspension assembly 224 that includes at least one tension spring and may include damping means of known kind, e.g., similar to a shock absorber structure in tension, to provide a flexible support to wedge 206 that is also somewhat elastic in the vertical direction. Suspension assembly 224 is pivotally supported at pivot 226 at the end of a cantilever arm 228 which is itself supported in part by a vertically adjustable hydraulic cylinder 230 that can move up and down along a vertical member 232 pivotally supported about the same axis as pneumatic support wheels 234 of mobile unit 200. Each wheel 234, one on each side of unit 200, has a corresponding individually vertically adjustable hydraulic cylinder 230 therabove. This provides the operator with the facility to cope with even quite uneven and non-planer expanses of reinforced pavement.

Arm 228 is attached not only to cylinder 230 but also to an arm 236 extending on an opposite side thereof and pivotally connected at a pivot 238 at a distal end. Pivot 238 is supported on a portion of the structure of mobile unit 200.

The entire structure described thus far, through the use of appropriate hydraulic cylinders and controls associated therewith, can be used by the operator to adjust the vertical height of pivot 226, and thus an intermediate point of wedge 206, as well as to concurrently adjust the height of pivot 220 supporting the rear end of wedge 206 with respect to the underlying ground 150. This is best understood with reference to FIG. 2B. Persons skilled in the mechanical arts will immediately appreciate that this structure enables wedge 206 to, in essence, "float" as it advances at its forward leading edge 212 under hitherto uncracked reinforced pavement 148.

A very important advantage of this structure, during use, is that the impacts by hammers 110 and 112 generate intense compressive forces downwardly from the upper surface of the approaching reinforcement pavement layer in a manner that initiates separation of the bulk component of the pavement from any reinforcement contained therein. An analogy may be drawn with the case of a person holding a substantial piece of ice in one hand and hitting it with a heavy hammer on the top surface thereof. Most of the energy carried in the falling hammer will then be absorbed in the flexibly and elastically supported piece of ice and cracks will propagate downward into it from it uppermost surface where it was struck. In exactly the same manner, the flexibly and elastically supported floating wedge enables each of the falling hammers to transmit its kinetic energy at the moment of impact to provide energy that stresses the bulk component, e.g. concrete in most reinforced pavements, so as to crack the same and loosen it with respect to the conventional reinforcement bars or netting contained therein. Note that portions of the vertical elasticity are provided by pneumatic tires of wheels 234, the compressibility of hydraulic fluid in cylinder 230, possible extension of the spring in support assembly 224 and the "planing" suspended action of wedge 206. The net effect is to facilitate the initiation and propagation of cracks in the approaching reinforced pavement.

It is believed that for reinforced pavement of approximately nine inches thickness, as is common in highway construction in the United States, lifting the forward hammer 110 and rear hammer 112 to a height of approximately three feet above the reinforced pavement, with each hammer weighing approximately twelve-thousand pounds, and sequential impacting of the hammers at a rate that generates at least one impact (from either one of the hammers) approximately every one inch of travel by the hammers with respect to the reinforced pavement produces highly efficient cracking of concrete from reinforcement bars in the pavement. Actually, it is always the prevailing circumstances must dictate appropriate adjustment of all operating parameters. An operator skilled in the use of the described invention should be able to adjust such parameters as necessary during use of the system.

As the cracked reinforced pavement passes the rear portion of wedge 206 it reaches a flat conveyer belt 240 that enables it to reach a predetermined height at which a full-width, sharp-pronged, high speed, power driven roller 242 operates to pull the cracked pavement upward while crushing the bulk component thereof into small pieces. This is best understood with reference to FIG. 2B. The broken pieces 264 (see FIG. 8) of the bulk component then fall downward across the full width of the approaching reinforced pavement and are guided by metal guides 244, which are conveniently freely rotatable belt conveyers inclined downwardly and inwardly of unit 200, whereby the pieces 264 of the bulk component are guided to a narrower conveyer belt 246. For symmetry, similar guides 244 are provided at both sides of conveyer belt 246, as best understood with reference to FIG. 3B. This conveyer belt 246 then raises the pieces 264 of the bulk component, now separated from the reinforcement 266 in the original pavement and carries the same, as best understood with reference to FIG. 1C to a discharge end through which the flow of bulk component pieces 264 is delivered to the vehicle 400.

The system operator can be advised by prearranged signal by the driver of truck 400 when the latter has a full load, whereupon the system operator may temporarily slow down the system or shut off conveyer belt 246 until a replacement truck 400 is again positioned below delivery end 248 and maintains motion in accordance with rest of the system.

The final breakdown of the bulk component into smaller pieces 264 and the effective separation thereof from reinforcement 266 contained within the original reinforced pavement is strongly facilitated by an impacting hammer 250 operated by hydraulic cylinder 252 at an upper portion of unit 200. Directly below the impacting face of hammer 250 is provided a plurality of steel bars 254 substantially normal thereto, as best understood with reference to FIGS. 2B and 7.

The Mengel reference, U.S. Pat. No. 4,692,058, cited earlier, illustrates in FIG. 2 and discusses in column 4, line 67 through column 5, line 19 thereof, the manner in which sawtooth profile 256 of hammer 250 coacts with bars 254 (as numbered here) to render the reinforced pavement. This portion of the Mengel reference is incorporated herein by reference for this aspect of its teaching. In the present invention, unlike Mengel, the intensity of the impact of hammer 250 is controlled so that only the bulk component is broken into pieces 264 that fall between bars 254 to be guided by guides 244 to conveyer belt 246 as previously described. The reinforcement 266, most likely metal bars or netting, is not broken with the bulk component by hammer 250 but, instead, passes to a hydraulically operated guillotine 258 actuated by hydraulic cylinder 260 that essentially chops the reinforcement 266 into pieces 268 and to convey the same by means of a transverse conveyor belt 262 to one side of the moving system delivery to a truck 500 for subsequent removal thereof. This is best understood with reference to FIG. 3B.

The entire process, the pervious description having been understood, will become clearer by reference to FIG. 8 wherein it is seen how pieces 264 of the bulk component are separated from reinforcement 266 by hammer 250 and steel bars 254 to fall downward between the bars 254, as reinforcement material 266 is chopped by guillotine 258 into pieces 268 that fall on conveyer belt 262 for subsequent disposal thereof.

For a proper understanding of the structure of rear hammer 112, reference may be had to FIGS. 4 and 5 which illustrate how detachable inserts 270 are connected at the impact portion of hammer 112 to cooperate with other similarly attached and particularly shaped impact elements 272. The provision of detachable impact elements such as 270 and 272, these being shaped to localize and intensify the impact force, will apply strong compressive stresses from the uppermost surface of the reinforcement pavement and into the bulk material thereof to expedite the operation of the system.

FIG. 6 illustrates a similar structure with detachable impact force transmitting elements 274 (shaped generally like elements 272 of hammer 112) as utilized with hammer 110, which makes the first gravity-assisted impacts on the approaching reinforced pavement.

As is well known, the typical width of a highway in the United States is greater than twelve feet, the magnitude of the width of wedge 206 that is probably practical for safe use. Under such circumstances, by suitable attachment of an element such as 274 (see FIG. 6) at one end of hammer 110, the operator utilizing only mobile unit 100 can proceed at a relatively fast pace to generate a relatively narrow series of closely spaced lane separating cracks 276, as best seen in FIG. 3A. Thus, by making one early pass along a suitable length of a relatively wide stretch of reinforced pavement, the operator readies a section of a width that can be comfortably handled by the full width of wedge 206. This inherent lane separation feature is also a particular advantage of the present system in its preferred embodiment. Its utility is particularly pronounced when, for example, a relatively wide stretch of reinforced pavement, e.g., portion of an aircraft landing area or an expanse of pavement in a shopping mall, is to be removed by the system so as to separate the bulk component from the reinforcement component previously described. Making suitable passes with the length separator element, the operator can define strips of the reinforced pavement that can be tackled by the driven floating wedge 206 and a very wide expanse of reinforced pavement can thus be rapidly and easily removed in a highly efficient and expeditious manner.

It is expected that persons skilled in the art, upon developing an understanding of the foregoing disclosure, will consider utilizing obvious variations and equivalence of various aspects of the disclosed invention. Such variations within the spirit of this disclosure believed to be comprehended within the scope of the disclosed invention as defined by the claims appended hereto.

What is claimed is:

1. A mobile system for advancing to remove an existing layer of reinforced pavement, to continually separate a bulk component thereof from a reinforcement component present therein and to deliver the same separately in rendered form, comprising:

driving means for providing a forward drive to the system;

movable lifting means elastically supported in a vertical direction and driven forwardly by the drive means for thereby lifting a predetermined width of approaching reinforced pavement;

impact means for applying gravity-assisted controlled impact forces to the lifted reinforced pavement to generate successive cracks therein substantially across said width thereof;

means for rendering into pieces a bulk component of the cracked reinforced pavement, separating the bulk component pieces from a reinforcement component and delivering the rendered bulk component in a first flow; and means for rendering the separated reinforcement component into pieces and delivering the same in a second flow, both the bulk component rendering means and the reinforcement component rendering means being adapted to move in concert with the lifting means and the impact means.

2. A mobile system according to claim 1, wherein:

said movable lifting means comprises an acute angle non-rigidly supported wedge that is forcibly driven under an approaching portion of the reinforced pavement to lift and move the same relative to a leading horizontal edge portion of the wedge over an upwardly inclined first face thereof.

3. A mobile system according to claim 2, wherein:

said impact means is adapted to apply a first controlled impact force to an upper surface of the lifted reinforced pavement substantially over and along said edge portion of the wedge.

4. A mobile system according to claim 3, wherein:

said impact means is adapted to apply a second controlled impact force to said upper surface of the lifted reinforced pavement over the first face of the wedge behind and above the edge portion.

5. A mobile system according to claim 2, further comprising:

means for pivotally supporting the wedge at a rear portion thereof.

6. A mobile system according to claim 5, further comprising:

means for pivotally supporting the wedge at a point intermediate the leading edge portion and the rear portion thereof.

7. A mobile system for advancing to remove an existing layer of reinforced pavement, to continually separate a bulk component thereof from a reinforcement component present therein and to deliver the same separately in rendered form, comprising:

driving means for providing a forward drive to the system;

movable lifting means driven forwardly by the drive means for thereby lifting a predetermined width of approaching reinforced pavement, said movable lifting means comprising an acute angle non-rigidly supported wedge that is forcibly driven under an approaching portion of the reinforced pavement to lift and move the same relative to a leading horizontal edge portion of the wedge over an upwardly inclined first face thereof;

impact means for applying gravity-assisted controlled impact forces to the lifted reinforced pavement to generate successive cracks therein substantially across said width thereof;

means for rendering into pieces a bulk component of the cracked reinforced pavement, separating the bulk component pieces from a reinforcement component and delivering the rendered bulk component in a first flow;

means for rendering the separated reinforcement component into pieces and delivering the same in a second flow, both the bulk component rendering means and the reinforcement component rendering means being adapted to move in concert with the lifting means and the impact means;

means for pivotally supporting the wedge at a rear portion thereof;

means for pivotally supporting the wedge at a point intermediate the leading edge portion and the rear portion thereof; and movable elastic support means for providing controlled elastic support in the vertical direction to said rear portion support means an said intermediate portion support means.

8. A method of continually breaking up and removing reinforced pavement and simultaneously separating a bulk component thereof from a reinforcement component and delivering small pieces thereof in two separate flows, comprising the steps of:

forcibly driving a flexibly suspended acute angled elongate wedge having a horizontal forward edge under an approaching portion of reinforced pavement;

applying a first plurality of blows onto an upper surface of reinforced pavement over an upper surface of the wedge to crack the reinforced pavement;

applying a second plurality of blows onto an upper surface of the cracked reinforced pavement supported over a plurality of spaced apart bars to break up into small pieces a bulk component of the reinforced pavement from a reinforcement component thereof;

applying a cutting force to cut the reinforcement component into small pieces; and delivering the small piece of the bulk component and the reinforced component separately.

* * * * *